US012403388B2

(12) United States Patent
Molund

(10) Patent No.: US 12,403,388 B2
(45) Date of Patent: Sep. 2, 2025

(54) POLYHEDRAL DICE

(71) Applicant: Peter Molund, London (GB)

(72) Inventor: Peter Molund, London (GB)

( * ) Notice: Subject to any disclaimer, the term of this patent is extended or adjusted under 35 U.S.C. 154(b) by 0 days.

(21) Appl. No.: 18/452,838

(22) Filed: Aug. 21, 2023

(65) Prior Publication Data

US 2024/0091629 A1 Mar. 21, 2024

Related U.S. Application Data

(60) Provisional application No. 63/401,692, filed on Aug. 28, 2022.

(51) Int. Cl.
*A63F 9/04* (2006.01)

(52) U.S. Cl.
CPC ..... *A63F 9/04* (2013.01); *A63F 2009/0437* (2013.01); *A63F 2009/0486* (2013.01)

(58) Field of Classification Search
CPC ..... A63F 9/04; A63F 2009/0437; A63F 2009/0486
See application file for complete search history.

(56) References Cited

U.S. PATENT DOCUMENTS 645,112 A * 3/1900 Mapes ..... A63F 9/0415 D21/373
1,419,056 A * 6/1922 Kaufman ..... A63F 9/0415 D21/373
2,024,541 A * 12/1935 Silkman ..... A63F 9/1204 273/156
3,608,905 A * 9/1971 Edison ..... A63F 1/16 273/146
4,989,875 A * 2/1991 Capy ..... A63F 9/0415 273/146
5,125,660 A * 6/1992 Stahl ..... A63F 9/0413 273/146
5,145,175 A * 9/1992 Gathman ..... A63F 9/0415 273/306
5,224,708 A * 7/1993 Gathman ..... A63F 9/0415 273/306
6,120,377 A * 9/2000 McGinnis, Sr. ..... G07F 17/34 463/20
6,123,333 A * 9/2000 McGinnis, Sr. .... G07F 17/3244 273/146
7,582,011 B2 * 9/2009 Maling ..... A63F 3/00157 463/16
D634,370 S * 3/2011 Gebhart ..... D21/373
8,074,986 B1 * 12/2011 Gebhart ..... A63F 9/0415 273/146
D722,341 S * 2/2015 MacDonald ..... D21/373
D722,651 S * 2/2015 MacDonald ..... D21/373
D730,453 S * 5/2015 MacDonald ..... D21/373
(Continued)

*Primary Examiner* — William M Pierce

(57) ABSTRACT

A die, or sets thereof, with at least twelve sides, displaying indicia from two sets of indicia; one indicium from a set of six indicia, together with another indicium from a set of four indicia. In the preferred embodiment, the die, or sets thereof, is a twelve-sided dodecahedron-shaped die and the indicia consists of ranks and suits, respectively. The ranks are displayed twice on each die, and the suits are displayed thrice on each die. Further, in the preferred embodiment, there are four kinds of this die. These kinds display different configurations of rank-suit indicia, which allows for a variety of scores to be formed, across sets of said dice.

7 Claims, 1 Drawing Sheet

(56) References Cited

U.S. PATENT DOCUMENTS

| | | | | | |
|---|---|---|---|---|---|
| D740,372 | S | * | 10/2015 | MacDonald | D21/373 |
| D740,889 | S | * | 10/2015 | MacDonald | D21/373 |
| D890,266 | S | * | 7/2020 | Lee | D21/373 |

* cited by examiner

POLYHEDRAL DICE

BACKGROUND

Dice with playing card indicia, i.e., dice displaying a combination of rank and suit indicia, commonly referred to as poker dice, have existed for a long time; an early patent dates to 1881, US. Pat. No. 244,520. Most versions of poker dice are presented in a standard six-sided cube format.

On a six-sided poker die, the four traditional playing card suits cannot be evenly distributed, unless two sides of the die lack suit indicia. The disadvantage of an uneven distribution of suit indicia, across a set of dice, e.g., where some of the dice feature two instances of a particular suit and others only feature one instance of the same suit, is that the probability of rolling a particular suit depends on the die or dice already rolled, or left to roll. The player must keep track of individual dice to estimate the probabilities of suit-based scores, and it is more challenging to gain an intuition of the scoring probabilities through playing the game over time, as the frequency of rolling suit-based scores will fluctuate from one scenario to another, depending on the die or dice already rolled, or left to roll. The disadvantage of leaving two sides without suit indicia, on the other hand, is that the probability of rolling a particular suit is one in six, the same as a rolling a particular rank, which makes the distinction between ranks and suits less meaningful from a game design point of view. For example, there would be no meaningful rank order difference, and associated point difference, between rolling five ranks of the same kind (known as a five of a kind) and five suits of the same kind (known as a flush).

Poker dice of other polyhedrons have been patented, including twelve-sided dice, e.g., US. Pat. No. 645,112; U.S. Pat. Nos. 3,608,905; 5,145,175; and 5,224,708. While these dice provide evenly distributed suit indicia, the probability of rolling a particular rank differs from the standard die's one-in-six probability. This might not be a material disadvantage for the preferred use for most of these dice, namely games that simulate the gameplay of poker, and other card games. Indeed, several of these dice are explicitly designed to distribute the 52 rank-suit combinations of a standard playing card deck across a set of dice, in which the ranks are symmetrically distributed over the set so that, by design, no rank features more than once on a single die. The probability of rolling a particular rank of such a die, consequently, is equivalent to one divided by the number of sides of said die.

There are certain games, however, where it would be a disadvantage to use a die where the probability of rolling a particular rank differs from a standard die. Such games would, generally, include games from the genre of dice games sometimes called "category games," which includes games such as Yatzy, Yacht and Generala. Most casual players with experience of playing such games have developed an intuition for the scoring probabilities using a standard six-sided die, and they could find it challenging to adjust to a category game with a score category structure they are generally familiar with, but that employs dice where the probability of rolling a particular rank differs from the standard die.

SUMMARY OF THE INVENTION

The present invention comprises one or more dice, with at least twelve sides, wherein at least twelve sides display two indicia; one indicium from a set of six indicia, together with another indicium from a set of four indicia. The indicia are displayed the same number of times on each die; the first indicium is displayed at least twice on each die and the second indicium is displayed at least thrice on each die. The invention may be embodied in both physical and electronic forms, or a combination thereof.

In the preferred embodiment, the die, and sets thereof, is a twelve-sided dodecahedron-shaped die and the indicia consist of ranks and suits, respectively. The ranks are displayed twice on each die, and the suits are displayed thrice on each die. For a poker die, this is the geometrically most parsimonious solution to preserve a standard die's one-in-six probability of rolling a particular rank, while providing identical probability of rolling a particular suit across a set of dice, in which said dice display rank-suit combinations on all sides.

Further, in the preferred embodiment, there are four kinds of this die. The first kind displays the ranks Ace, Two, Three, Four, Five, Six, wherein the odd ranks are combined with the suits Spades and Hearts, while the even ranks are combined with Diamonds and Clubs. The second kind also displays the ranks Ace, Two, Three, Four, Five, Six, but the odd ranks are combined with the suits Diamonds and Clubs, while the even ranks are combined with Spades and Hearts. The third kind displays the ranks Seven, Eight, Nine, Jack, Queen, King, wherein the odd ranks are combined with the suits Spades and Hearts, while the even ranks are combined with Diamonds and Clubs. The second kind also displays the ranks Seven, Eight, Nine, Jack, Queen, King, but the odd ranks are combined with the suits Diamonds and Clubs, while the even ranks are combined with Spades and Hearts. The advantage of displaying inverse odd rank-suit combinations on the second and fourth kind, in relation to the first and third kind, respectively, is that it allows for sets of these dice to form a consecutive series of ranks of the same suit, known as a straight flush. The benefit of the rank configuration the third and fourth kind, in relation to the first and second kind, is that these dice can be used in combination with dice of the first and second kind to form a series of consecutive ranks, wherein a Seven is consecutive to a Six and a King is consecutive to an Ace.

A fifth kind of die is employed in the preferred embodiment of the invention; it is a dodecahedron-shaped die with Joker, or Jackpot, indicia on two sides, with remaining ten sides being blank.

The dice so described are used for playing games in the "category games" genre in the preferred embodiment, but are not restricted to these games.

BRIEF DESCRIPTION OF THE DRAWINGS

FIG. 1 shows the configuration of indicia on each side of the first kind of die.

FIG. 2 shows the configuration of indicia on each side of the second kind of die.

FIG. 3 shows the configuration of indicia on each side of the third kind of die.

FIG. 4 shows the configuration of indicia on each side of the fourth kind of die.

FIG. 5 shows the configuration of indicia on each side of the fifth kind of die.

DETAILED DESCRIPTION

The following dice describe the preferred embodiment but the invention is not restricted to this particular embodiment.

Figure 1:
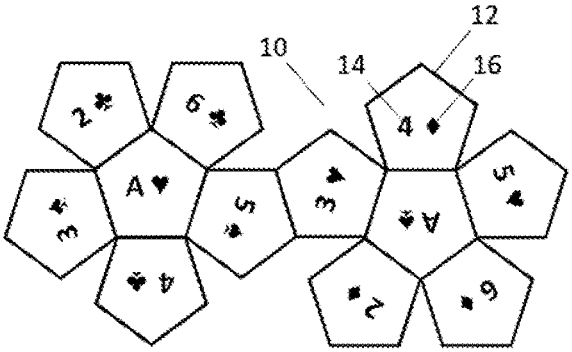
FIGS. 1-5 provide two-dimensional views of all twelve sides of six kinds of dodecahedron-shaped dice, each kind of die displaying one of five distinct indicia configurations, in the preferred embodiment of the invention.

FIG. 1 shows a first kind of dodecahedron-shaped die 10 wherein each pentagonal side 12 displays a rank 14 in combination with a suit 16. Each of the ranks Ace (A), Two (2), Three (3), Four (4), Five (5) and Six (6) are displayed on two sides of the die, and each of the suits Spades (S), Hearts (H), Clubs (C) and Diamonds (D) are displayed on three sides of the die. The odd ranks are combined with Spades and Hearts (AS, AH, 3S, 3H, 5S, 5H) and the even ranks are combined with Clubs and Diamonds (2C, 2D, 4C, 4D, 6C, 6D), so that each consecutive rank is alternating in suit.

Figure 2:
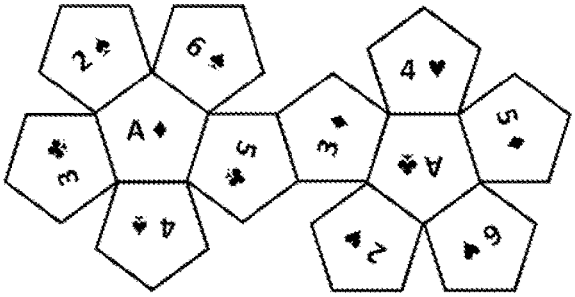

FIG. 2 shows a second kind of die with the same features as the die shown in FIG. 1 except that the rank-suit combinations are inversed so that the odd ranks are combined with Clubs and Diamonds (AC, AD, 3C, 3D, 5C, 5D) and the even ranks are combined with Spades and Hearts (2S, 2H, 4S, 4H, 6S, 6H).

Figure 3:
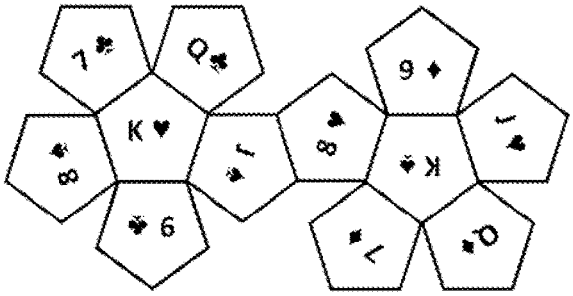

FIG. 3 shows a third kind of die with the same features as the dice shown in FIGS. 1 and 2 except that the ranks comprise Seven (7), Eight (8), Nine (9), Jack (J), Queen (Q) and King (K), instead of Ace, Two, Three, Four, Five and Six, and the ranks Eight, Jack and King are combined with Spades and Hearts (8S, 8H, JS, JH, KS, KH) while the ranks Seven, Nine and Queen are combined with Clubs and Diamonds (7C, 7D, 9C, 9D, QC, QD).

Figure 4:
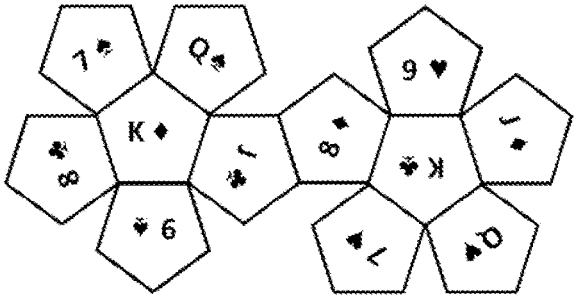

FIG. 4 shows a fourth kind of die with the same features as the die shown in FIG. 3 except that the rank-suit combinations are inversed so that the ranks Eight, Jack and King are combined with Clubs and Diamonds (8C, 8D, JC, JD, KC, KD) while the ranks Seven, Nine and Queen are combined with Spades and Hearts (7S, 7H, 9S, 9H, QS, QH).

Figure 5:
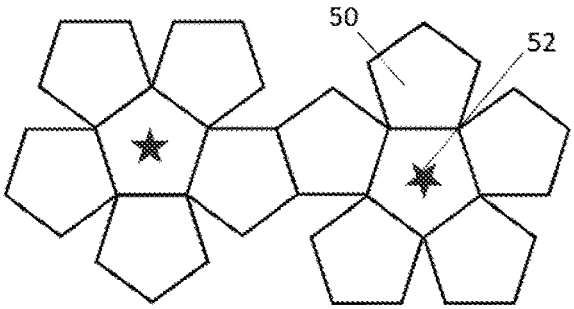

FIG. 5 shows a fifth kind of dodecahedron-shaped die wherein ten of the pentagonal sides are blank 50 and wherein two of the sides display an indicium for the of Joker (★) 52. An alternative version of the fifth kind of die displays the indicia of Jackpot ( ) instead of Joker.

By virtue of each rank being displayed twice on each kind of die in FIG. 1-5, a characteristic of these dice is that the probability of rolling a particular playing rank is identical to rolling a particular pip configuration with a standard six-sided die, i.e., one in six. This makes the probabilities of these dice, despite their relatively unorthodox shape, more intuitive for a novice player who is only be familiar with games involving standard six-sided dice, than if these dice had any other multiple of distinct ranks displayed. By virtue of each suit being displayed thrice on each kind of die in FIG. 1-4, a further characteristic of these dice is that the probability of rolling a particular suit is the same for each die, i.e., one in four.

By virtue of each kind of die in FIGS. 1 and 2 displaying all consecutive ranks, a further characteristic of these dice is that rolling a set comprising these dice may result in some or all of the dice producing a consecutive series of ranks, e.g., AS-2D-3S-4H-5D (known as a straight) and by virtue of each kind of die in FIGS. 1 and 2 displaying all distinct card suits, a further characteristic is that rolling a set comprising these dice may result in some or all of the dice producing a series of the same suit, e.g., AS-AS-4S-5S-6S (known as a flush). By virtue of the dice in FIGS. 1 and 2 displaying inverse odd rank-suit combinations in relation to each other, a further characteristic of these dice is that rolling a set comprising these dice may result in some or all of the dice producing a consecutive series of ranks of the same suit, e.g., AS-2S-3S-4S-5S (known as a straight flush).

By virtue of the dice in FIGS. 3 and 4 displaying ranks that are consecutive in relation to the highest and lowest ranks of the dice in FIGS. 1 and 2, 7-8-9 being consecutive in relation to 6 and J-Q-K being consecutive in relation to A, provided that A can be treated as consecutive to both K and 2, a characteristic of these dice is that rolling a set comprising these dice may result in some or all of the dice producing ranks that can be combined with ranks produced by the dice in FIGS. 1 and 2 to produce a consecutive series of ranks, e.g., KH-AS-2D-3S-4H-5D. By virtue of each kind of die in FIGS. 3 and 4 displaying all distinct card suits, a further characteristic is that rolling a set comprising these dice may result in some or all of the dice producing suits that can be combined with suits produced by the dice in FIGS. 1 and 2 to produce a series of the same suit, e.g., AS-AS-4S-5S-6S-9S. By virtue of the dice in FIGS. 3 and 4 displaying inverse combinations of odd rank-suit combinations in relation to each other, a further characteristic of these dice is that rolling a set comprising these dice may result in some or all of the dice producing rank-suit combinations that can be combined with rank-suit combinations produced by the dice in FIGS. 1 and 2 to produce a consecutive series of ranks of the same suit, e.g., AS-AS-4S-5S-6S-9S.

By virtue of the kind of die in FIG. 5 displaying Joker indicia, or Jackpot indicia, which can be treated as "wild", i.e., they may represent any rank-suit combination, rolling a set comprising this kind of die may result in some or all of the dice producing a Joker, or Jackpot, which may be used to create, or combine with, any relevant combination, e.g., a consecutive series of ranks such as KH-★-2D-3S-4H-5D, a series of the same suit such as AS-AS-4S-5S-6S-★ or a consecutive series of ranks of the same suit such as KS-AS-2S-3S-★-5S.

The dice so described are used in dice games belonging to the genre "category games" in the preferred embodiment of the invention, but the invention is not restricted to these games. The game described below, is the preferred game for the employment of said dice.

The game employs three dice of the kind shown in FIG. 1, two dice of the kind shown in FIG. 2, one die of the kind shown in FIG. 3, one die of the kind shown in FIG. 4, and two dice of the kind shown in FIG. 5. The five dice of FIGS. 1 and 2 will hereinafter collectively be referred to as the "Base dice", the two dice of FIGS. 3 and 4 as the "Court dice", two dice of FIG. 5 as a "Joker die" and a "Jackpot die".

A turn starts by a player first rolling the five Base dice. After the first roll, the player may opt to re-roll some, none or all of the Base dice. After the second roll, the player may again opt to re-roll some, none or all of the Base dice. Once the player has decided to not re-roll any more Base dice or when the two permissible re-rolls have been exhausted, the player may roll the two Court dice together with the Joker die once. The player may then combine the result of the Base dice, Court dice and Joker die to form any combination that qualify for any of the eighteen "Ranks," "Multiples" and "Arrays" score categories in TABLE A below.

Once a player has selected to score in a score category, the player may not score again in that same category for the remainder of the game. If the dice do not qualify for any unscored score category, the player must select a score category to forgo for the remainder of the game. Once a player has selected to score in a score category, or a score category to forego, the score is calculated based on the below table and entered onto a score card, after which the turn ends. The process is repeated for each player in turn until all eighteen turns have been completed for every player. The "Bonuses & Penalties" score categories are calculated and the player with highest total when summing all scores wins the game.

TABLE A

| RANKS Category | Score |
|---|---|
| Aces | Sum |
| Twos | Sum |
| Threes | Sum |
| Fours | Sum |
| Fives | Sum |
| Sixes | Sum |

| MULTIPLES Category | | | | | Score | | | | |
|---|---|---|---|---|---|---|---|---|---|
| Chance | | | | | Sum | | | | |
| High Die | | | | | Sum | | | | |
| One Pair | + 1 Pair | | | | Sum | Sum | | | |
| Three of a Kind | + 1 Pair | + 3 of a Kind | | | Sum | Sum | Sum | | |
| Four of a Kind | + 1 Pair | + 3 of a Kind | + 3 of a Kind and Ace | | Sum | Sum | Sum | Sum | |
| Five of a Kind | + 1 Pair | + 3 of a Kind + 4 of a Kind + 5 of a Kind | | | 60 | 120 | 240 | 480 | 480* |

| ARRAYS Category | | | | | Score | | | | |
|---|---|---|---|---|---|---|---|---|---|
| Flash | | | | | 35 | | | | |
| Sm. Straight | +1 boost | +2 boost | +3 boost | Jackpot | 20 | 40 | 80 | 160 | 320 |
| Lg. Straight | +1 boost | +2 boost | +3 boost | Jackpot | 20 | 40 | 80 | 160 | 320 |
| Red Flush | +1 boost | +2 boost | +3 boost | Jackpot | 25 | 50 | 100 | 200 | 400 |
| Black Flush | +1 boost | +2 boost | +3 boost | Jackpot | 25 | 50 | 100 | 200 | 400 |
| Straight Flush | +1 boost | +2 boost | +3 boost | Jackpot | 125 | 250 | 500 | 1000 | 2000 |

| BONUSES & PENALTIES Category | | | | | Score | | | | |
|---|---|---|---|---|---|---|---|---|---|
| Ranks Total ≥ 63 | ≥73 | ≥83 | ≥93 | ≥103 | 60 | 120 | 260 | 620 | 1800 |
| Cross-Outs =1 | =2 | =3 | ≥4 | | −50 | −75 | −90 | −100 | |
| Five Aces | 5 Ace Yatzy | 5 Ace Flash | | | 25 | 50 | 500 | | |
| Royal Flush | | Royal Flush in Spades | | | 1000 | 3000 | | | |
| Dead Man's Roll | | | | | Accumulated score and instant loss | | | | |
| Bankruptcy* | | | | | Accumulated score | | | | |

*Transfer of accumulated score

What is claimed is:

1. A dice set, comprising:

one or more dice, wherein each die is a dodecahedron, and wherein each side of each die displays a first indicium from a first set of six indicia in combination with a second indicium from a second set of four indicia, and wherein each indicium in the first set of six indicia is displayed two times on each die and wherein each indicium in the second set of four indicia is displayed three times on each die.

2. The dice set of claim 1 wherein, for at least one of the dice described in claim 1, the first set of indicia consists of the ranks of Ace, Two, Three, Four, Five and Six, and the second set of indicia consists of the suits of Spades, Hearts, Diamonds and Clubs.

3. The dice set of claim 1 wherein, for at least one of the dice described in claim 1, the first set of indicia consists of the ranks of Seven, Eight, Nine, Jack, Queen and King, and the second set of indicia consists of the suits of spades, Hearts, Diamonds and Clubs.

4. The dice set of claim 2 wherein at least one of dice described in claim 2 displays indicia indicating the combinations Ace-Spades, Two-Clubs, Three-Spades, Four-Clubs, Five-Spades, Six-Clubs, Ace-Hearts, Two-Diamonds, Three-Hearts, Four-Diamonds, Five-Hearts, Six-Diamonds.

5. The dice set of claim 2 wherein at least one of the dice described in claim 2 displays indicia indicating the combinations Ace-Clubs, Two-Spades, Three-Clubs, Four-Spades, Five-Clubs, Six-Spades, Ace-Diamonds, Two-Hearts, Three-Diamonds, Four-Hearts, Five-Diamonds, Six-Hearts.

6. The dice set of claim 3 wherein at least one of the dice described in claim 3 displays indicia indicating the combinations Seven-Spades, Eight-Clubs, Nine-Spades, Jack-Clubs, Queen-Spades, King-Clubs, Seven-Hearts, Eight-Diamonds, Nine-Hearts, Jack-Diamonds, Queen-Hearts, King-Diamonds.

7. The dice set of claim 3 wherein at least one of the dice described in claim 3 displays indicia indicating the combinations Seven-Clubs, Eight-Spades, Nine-Clubs, Jack-Spades, Queen-Clubs, King-Spades, Seven-Diamonds, Eight-Hearts, Nine-Diamonds, Jack-Hearts, Queen-Diamonds, King-Hearts.

* * * * *